United States Patent [19]

Hegel et al.

[11] Patent Number: 4,598,574

[45] Date of Patent: Jul. 8, 1986

[54] DIE CLAMPING DEVICE

[75] Inventors: Robert W. Hegel; William VanAppledorn, both of Holland, Mich.

[73] Assignee: Prince Corporation, Holland, Mich.

[21] Appl. No.: 736,656

[22] Filed: May 22, 1985

[51] Int. Cl.[4] ..... B21D 37/04

[52] U.S. Cl. ..... 72/481; 72/462; 299/60; 299/94

[58] Field of Search ..... 72/100, 460, 462, 481; 269/56, 58, 60, 91, 93, 94, 229, 231, 238, 239

[56] References Cited

U.S. PATENT DOCUMENTS

| | | | |
|---|---|---|---|
| 2,755,758 | 7/1956 | Johansen | 72/462 |
| 3,210,069 | 10/1965 | Holtz | 269/94 |
| 3,290,039 | 12/1966 | Lancaster | 269/60 |
| 4,500,081 | 2/1985 | Carossimo | 269/94 |

*Primary Examiner*—W. D. Bray

*Attorney, Agent, or Firm*—Price, Heneveld, Huizenga & Cooper

[57] ABSTRACT

A clamping device used for mounting die sections on machine platens, the device including a support carriage slidably mounted on the platen and having a clamp arm thereon. Means is provided for advancing and withdrawing the carriage from a die section on the platen and for moving the engaging end of the clamp arm toward and away from the platen, the carriage and clamp arm being activated from the periphery of the platen. Preferably, a camming assembly is engaged with an advancement screw and is slidably mounted on the platen to shift with the carriage. The camming assembly and the carriage are biased apart, but converge when the carriage contacts the edge of the die section in order to cam the clamp arm onto the die section.

26 Claims, 5 Drawing Figures

DIE CLAMPING DEVICE

BACKGROUND OF THE INVENTION

The present invention relates to clamping devices and more particularly to clamping devices that are used to mount mating dies or mold sections onto the faces of platens such as those of die casting machines.

In conventional machines, whether used for casting, forging, stamping, molding or the like, die sections are mounted on platens within the machine. Commonly a number of clamps are used to mount each die section upon the appropriate platen face. Each die section generally includes recesses in the sides thereof providing an outwardly extending flange that abuts the face of the platen and provides a means for clamping the die section against the platen. The clamps are generally mounted on the platen in T-shaped channels that extend along the platen face.

One well known clamp includes an L-shaped clamp member which has one leg extending into the side recess of the die over the flange which abuts the platen, thereby forming a clamping arm, and another leg extending downwardly and contacting the platen to provide a fulcrum about which the clamping arm pivots. The threaded end of a T-bolt extends through the clamping arm and a nut is threaded over the bolt to tighten the clamping arm against the die flange. When a number of such clamps are clamped down against the die, the die is firmly secured to the platen face.

More recently, another type of clamp was introduced having ramped undersurfaces along a forward portion that contacts a wedge positioned on top of the die flange. This type of clamp is tightened down on the die by forcing the clamping arm over the wedge located on the die flange and forcing the ramped undersurface firmly against the wedge.

Although the above clamping mechanisms operate adequately to mount a die upon a platen, with such clamps it is normally difficult and time consuming to change dies on the platens. An operator is required to reach in between the spaced platens with tools in order to position and release or tighten the clamps. This reaching in between the platen faces presents a potentially severe safety hazard. Additionally, particularly in large machines, the platens are relatively large and the clamps may therefore be recessed quite a distance from the edge of the platen. It is extremely ackward to reach in between the platens such a distance and still retain enough stability to be able to tighten or loosen the clamps. Further, such machinery usually includes a large amount of hydraulic lines, housing members, controls and other equipment in the vicinity of the platens. Such equipment blocks entry to the platens and makes access back into the clamps difficult.

Time consuming die changes increase the down time for the machine and greatly reduce the machine's output. Further, die changing has heretofore been a totally manual process which increases the labor costs associated with each end product.

SUMMARY OF THE INVENTION

The present invention solves the problems noted above by providing a clamping device mounted on the die sections of the platen and which is adjusted outside the periphery of the platen. Preferably the invention is embodied in a clamping device having a support that may be slidably mounted in the existing T-shaped channels in a platen face. It includes a clamp arm that is pivotally mounted on the support. One end of the clamping arm is the clamping end which extends into the side recess of the die over the clamping flange. Means is provided for pivoting said clamp arm toward the clamping flange by means of a camming or ramping operation as the clamp arm is advanced into the recess over the clamping flange. Thus the advancement of the clamping arm into a clamping position in the recess automatically clamps the die to the platen. All of such operation is preferably accomplished by adjustments made substantially outside the periphery of the platen. In the alternative, such adjustment, and consequentially the clamping action, can be made by hydraulic motor drive.

In accordance with a preferred embodiment of this invention, the means for pivoting the clamping arm is a ramp type camming assembly coupled to the support, with an advancement screw that engages the camming assembly but does not engage the support. This advancement screw extends to the side of the platen in order to be accessible for adjustment. A spring biases the support ahead of the camming assembly, so that the support and camming assembly are advanced simultaneously by the advancement screw, even though the support does not engage the advancement screw. When the support contacts the edge of the die, the spring bias is overcome and the camming assembly converges upon the support. By continued adjustment of the advancement screw, the camming assembly is forced under the end of the clamp arm opposite the clamping end, causing the clamp arm to pivot and be forced down onto the flange of the die. A single adjustment nut therefore controls both the positioning of the clamping device and the clamping of the device onto the die edge.

It will be recognized that the present invention provides a clamping device that may be accessed readily from the side of the press machine. An operator is therefore not required to reach between the platens in order to adjust the clamp. The device greatly facilitates the changing of die sections as well as reduces the hazard associated with reaching between the platens. The clamping device is easy to position and adjust, since the operator simply adjusts a single adjustment nut until a given torque resistance is reached, at which time the clamping device will have both automatically moved to position adjacent the die and clamped down into a clamped position. The operator's adjustment of the device is therefore not dependent upon the size of the die perimeter or location of the die on the platen within certain rough tolerances. Due to this single adjustment aspect of the clamping device, the device is particularly well suited for operation by a motor. The clamping device is adapted for use with conventional platens, so that the device will retrofit to existing presses.

DETAILED DESCRIPTION OF THE PREFERRED EMBODIMENT

Figure 2:
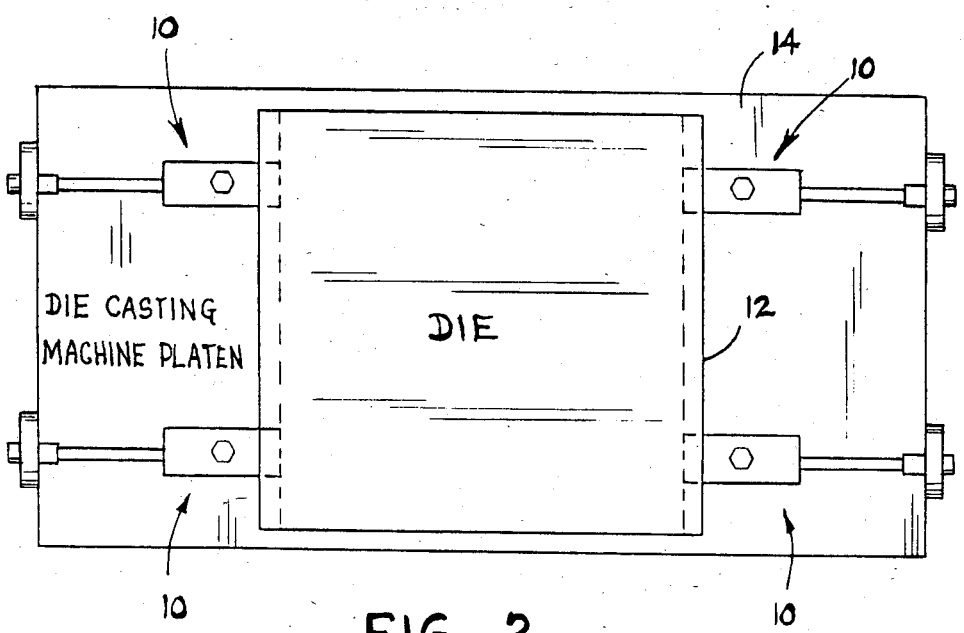
FIG. 2 is an elevational view of a horizontally movable platen having a die section mounted thereon, four of the clamping devices shown in FIG. 1 being used to clamp the die section to the platen.
Figure 3:
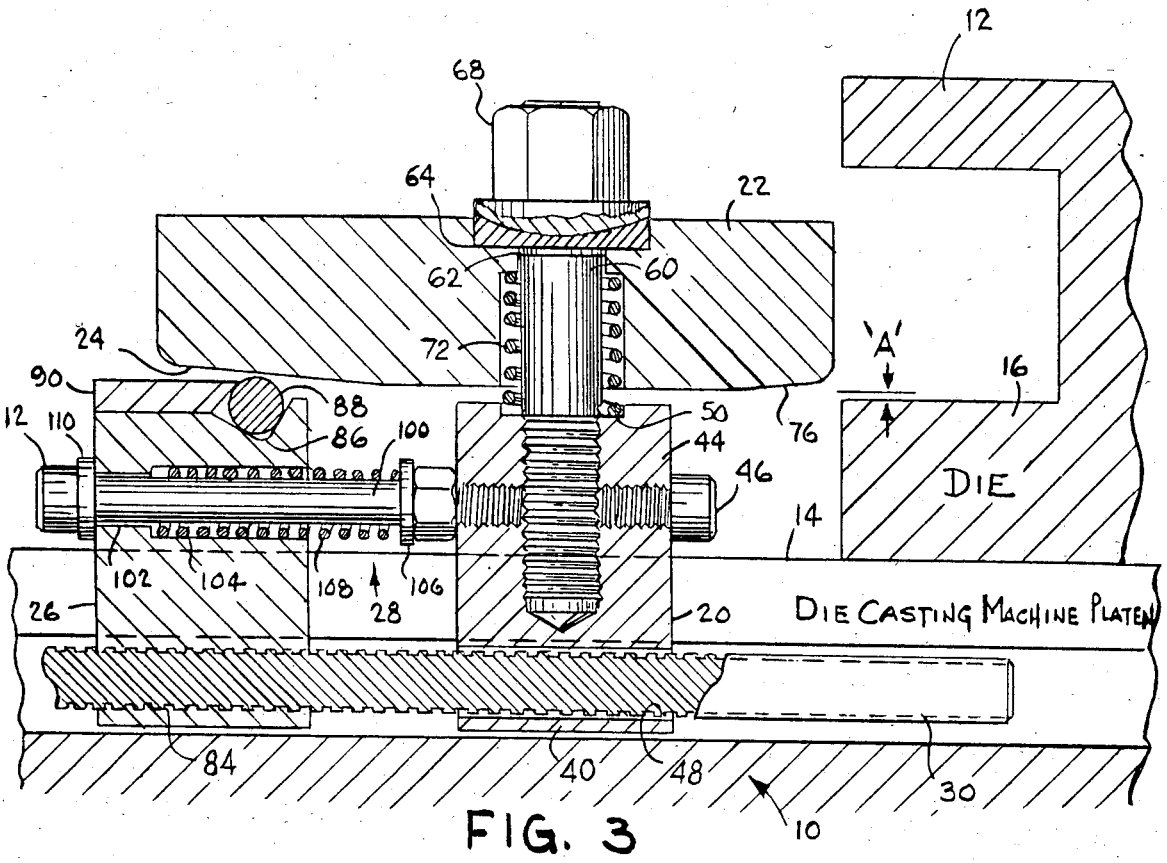
FIG. 3 is a fragmentary, sectional view of the clamping device of FIG. 1 and a die section, shown with the clamping device in an unclamped condition.
Figure 4:
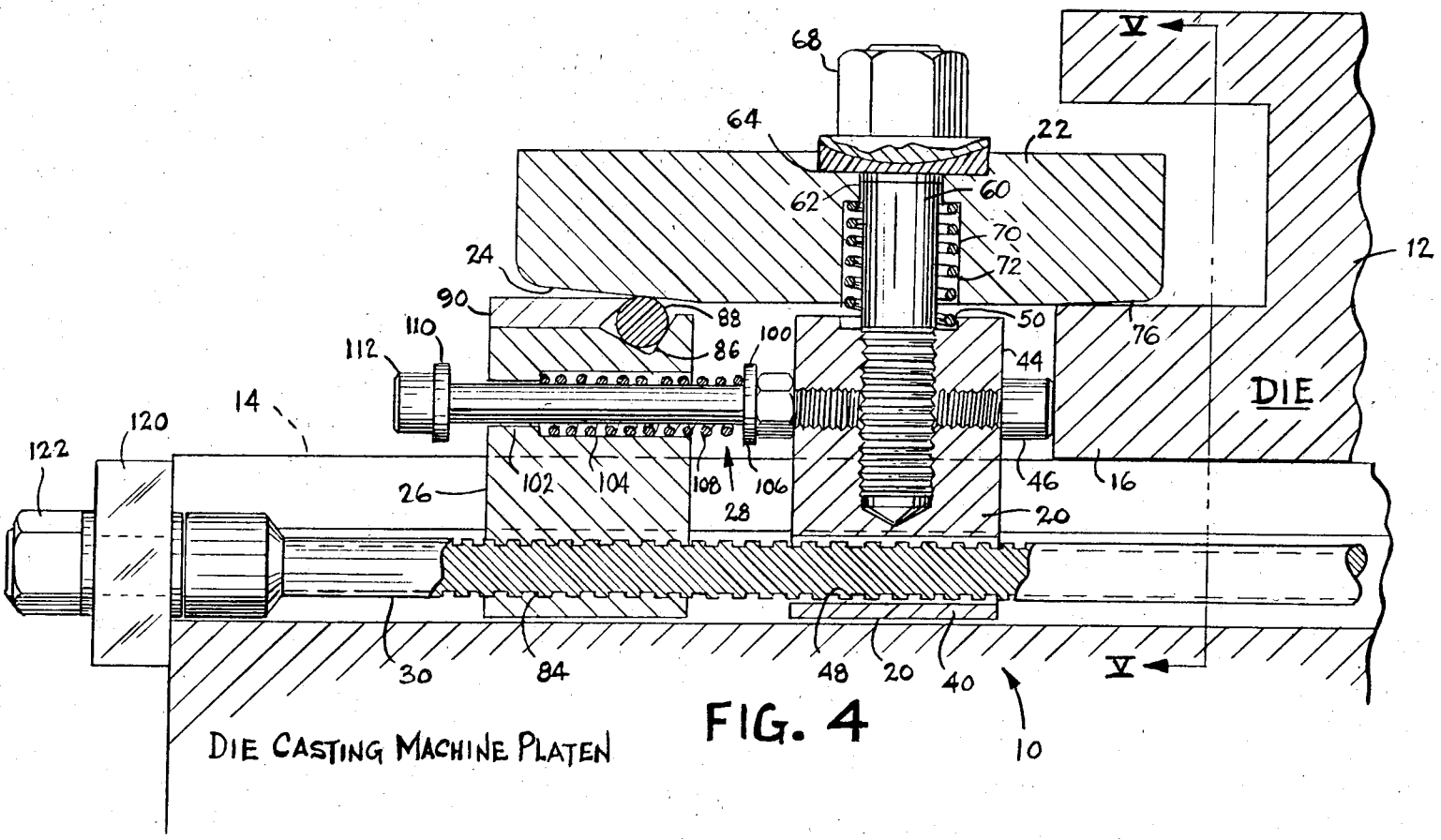
FIG. 4 is a fragmentary, sectional view of the clamping device showh in FIG. 1 and a die section, shown with the clamping device in a clamped condition.

In the preferred embodiment as shown in FIG. 2, four clamping devices 10 are used to mount a die or mold section 12 onto a platen 14. As shown in FIGS. 3 and 4, die section 12 includes a recess forming an outwardly extending clamping flange 16 on which device 10 clamps for clamping die 12 to the platen 14.

Figure 5:
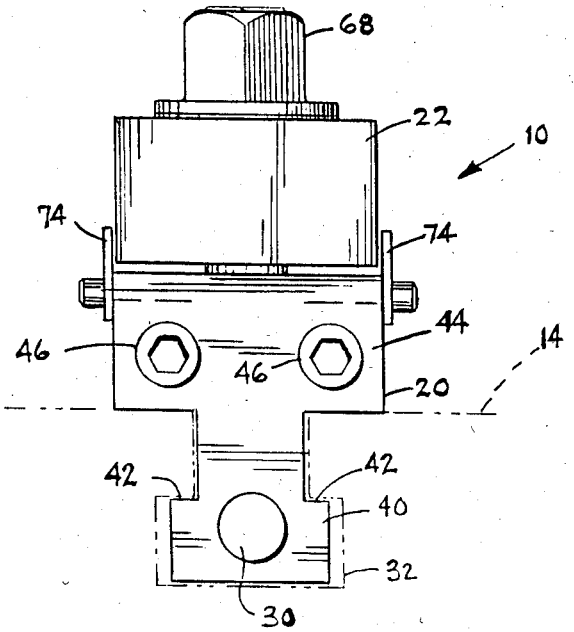
FIG. 5 is a front end view of the die clamping device shown in FIG. 1.

Clamping device 10 includes a support block or carriage 20 upon which is mounted a clamp arm 22. Clamp arm 22 includes a ramped undersurface 24 on one end that is used in the pivoting of clamp arm 22 in lever-like fashion. A camming assembly 26 is coupled to carriage 20 by a coupling means 28 which normally permits assembly 26 and carriage 20 to move in unison, but also permits them to converge and diverge. An advancement screw 30 is threaded through assembly 26 but extends freely through carriage 20, so that the rotation of screw 30 normally advances camming assembly 26 which thereby advances carriage 20 through coupling means 28. The lower portion of carriage 20 and assembly 26 as well as advancement screw 30 extend into a conventional T-shaped platen slot 32 (FIG. 5). As shown in FIGS. 3 and 4, when clamp device 10 is mounted upon platen 14, screw 30 may be rotated in order to advance both carriage 20 and assembly 26 until carriage 20 contacts die section 12. Thereafter, coupling means 28 permits assembly 26 to continue to be advanced, thereby wedging under ramped undersurface 24 causing clamp arm 22 to pivot on carriage 20 and clamp down onto flange 16. Screw 30 therefore provides a single adjustment that both positions clamping device 10 relative the particular die section 12 to be mounted and also clamps clamp arm 22 onto die section 12.

Figure 1:
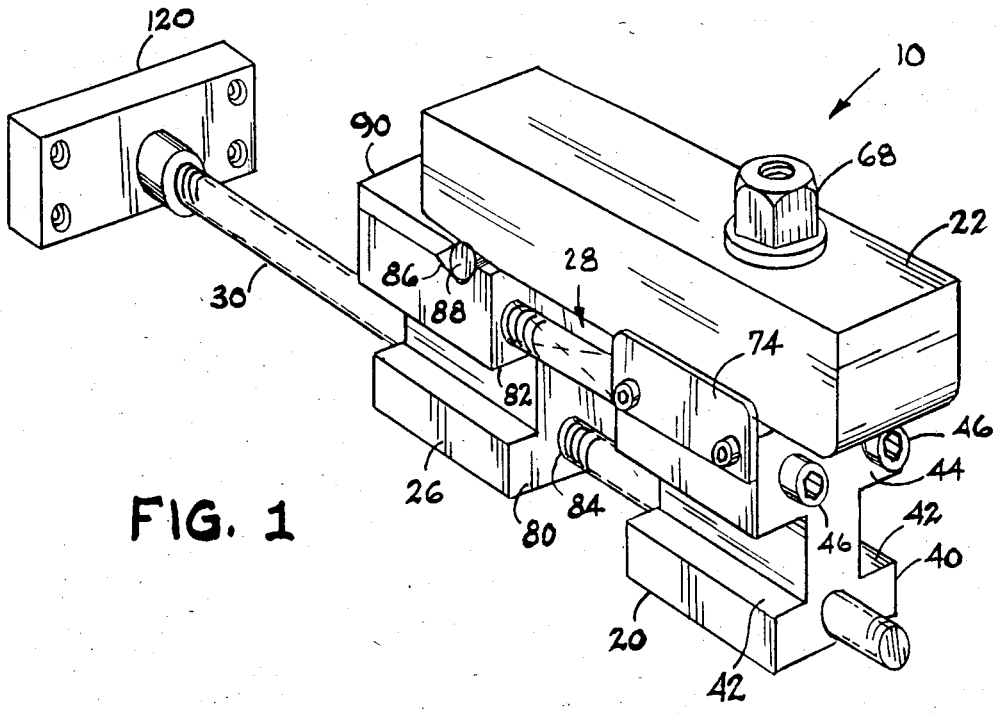
FIG. 1 is a front perspective view of a clamping device embodying the present invention.

As shown in FIGS. 1 and 3, carriage 20 includes a lower T-shaped base portion 40 that is received within T-shape channel 32 on platen 14. Base portion 40 is configured so as to fit in the T-slot of the platen 14. The "T" configuration of base portion 40 provides a pair of shoulders 42 that will bear against the corresponding portion of channel 32 when clamping device 10 is locked into position. The upper portion of carriage 20 forms an enlarged block having a forward face 44 into which are set a pair of spaced bumpers 46 which are threaded into forward face 44 above platen 14. Extending longitudinally through the center of T-shaped base portion 40 is an aperture or channel 48 through which extends advancement screw 30, FIGS. 3 and 4. Aperture 48 has a diameter somewhat larger than the maximum diameter of advancement screw 30, so that carriage 20 slides freely over screw 30 permitting the converging and diverging of carriage 20 and assembly 26. On the upper surface of carriage 20 is a circular recess 50 (FIGS. 3 and 4) that is used as a spring seat in the mounting of clamp arm 22.

Clamp arm 22 includes a mounting aperture 62 located somewhat forward of the center line of clamp arm 22 in order to give clamp arm 22 a mechanical lever advantage as explained below. On the upper surface of clamp arm 22 is an insert 64 that surrounds aperture 62 and has a hemispherical upper surface forming a fulcrum surface for the mounting of clamp arm 22. A threaded shaft 60 extends through aperture 62 and is threadly received in the top of carriage 20. A nut 68 is received over the threaded end of shaft 60. Aperture 62 has a diameter sufficiently large to permit play between shaft 60 and clamp arm 22. This play permits nut 68 to act as a fulcrum against the bearing surface of insert 64 and permits clamp arm 22 to pivot in lever-like fashion.

On the undersurface of clamp arm 22 aperture 62 is of a greater diameter to form a spring seat 70 of the same diameter as spring seat 50. A coil spring 72 is seated in spring seats 50 and 70 so as to bias clamp arm 22 upward from carriage 20 and force the bearing surface of insert 64 against washer 66. Adjustment of nut 68 on shaft 60 adjusts the spacing of clamp arm 22 above carriage 20 while spring 72 biases clamp arm 22 upwardly. Nut 68 therefore acts as a course adjustment knob to set the spacing of clamp arm 22 above platen 14.

As shown in FIGS. 1 and 5, a pair of generally rectangular flat plates 74 are bolted to the sides of carriage 20 and extend upward along the sides of clamp arm 22. These plates 74 act as guides that prevent clamp arm 22 from shifting from side-to-side. The forward undersurface of clamp arm 22 is beveled toward the front to form an inclined surface 76 that within certain limits will ride over flange 16 in order to avoid minute adjustments in the position of the clamp arm 22.

Camming assembly 26 also includes a T-shaped base portion 80 that is configured to be received within standard platen channels, FIG. 1. The upper portion of assembly 26 forms an enlarged rectangular block, the block providing a pair of shoulders 82 that bear down against the face of platen 14. As shown in FIGS. 3 and 4, a threaded aperture 84 extends through the center of T-shaped base portion 80 and threadly engages screw 30. Along the upper surface of camming assembly 26 is a V-shaped groove or seat 86 in which is seated an elongated, cylindrical cam element or dowel 88. Dowel 88 is held in place by a retainer plate 90 bolted onto the upper surface of camming assembly 26 in conventional fashion. Locking plate 90 includes a leading knife edge that contacts dowel 88 so as to firmly hold dowel 88 in seat 86. Plate 90 is relatively narrow so as to be recessed beneath the uppermost portion of dowel 88. Dowel 88 has a diameter sufficiently large that its upper surface is located above the upper surface of plate 90 and will cam against surface 24 when carriage 20 and assembly 26 are converged. Dowel 88 therefore provides a cam that will slide or rotate smoothly along the entire width of ramped undersurface 24 of clamp arm 22. Dowel 88 is made of hardened metal but may be replaced by the removal of locking plate 90 when it becomes worn.

Coupling 28 includes a pair of spaced, horizontally aligned rods 100 that are bolted into the back of carriage 20 opposite forward contact bolts 46. Bolts 100 extend through a pair of apertures 102 that extend longitudinally through camming assembly 26. Apertures 102 have diameters larger than the diameters of coupling rods 100, so that rods 100 slide freely through camming assembly 26. Apertures 102 widen into a pair of spring seats 104 that face forward toward carriage 20. Two washers 106 located on rods 100 adjacent carriage 20 form another pair of seats for two coil springs 108 seated in seats 104 and biasing carriage 20 away from assembly 26. On the ends of rods 100 are a pair of washers 110 and enlarged bolt heads 112 that form a stop surface on coupling rods 100. Rods 100 therefore act to align carriage 20 and camming assembly 26 and also to limit the separation of assembly 26 from carriage 20.

Screw 30 is rotatably mounted in a mounting block 120 in a conventional fashion, FIGS. 1 and 4. It extends through block 120 but is permitted to rotate therein. An adjustment nut 122 is fixed to the end of rod 30 on the side of mounting block 120 opposite carriage 20 and assembly 26, FIG. 4. As adjustment nut 122 is turned, screw 30 turns and carriage 20 and assembly 26 move along the length of screw 30. Mounting block 120 may be bolted or welded to the side of platen 14 in any conventional fashion so that advancement screw 30 extends within platen channel 32.

In lieu of the manual actuation of screw 30, a hydraulic motor could actuate the screw whereby the clamping action could be controlled from a remote location. In such an embodiment, the hydraulic motor rotates the screw until a predetermined torque level is reached, thus indicating the clamping device has positively locked in position.

OPERATION

When clamping device 10 is mounted on platen 14, T-shaped base portions 40 and 80 are slid into platen channel 32 along with advancement screw 30. Mounting block 120 is bolted or otherwise secured to the side of platen 14. As shown in FIG. 3, clamp 10 is initially spaced to the side of die section 12 after die section 12 is positioned on platen 14. If the height of shoulder 16 on die section 12 is dramatically different from that of the die section being replaced, clamp arm 22 is coursely adjusted through use of adjustment nut 68. Since spring 72 lifts clamp arm 22 up off of carriage 20, as nut 68 is tightened down on threaded shaft 60, washer 66 clamps down on curve surface 64 to lower clamp arm 22. Adjustment nut 68 is only used to roughly set the clearance "A", FIG. 3, between the tapered end of clamp arm 22 and platen 14. When an appropriate clearance "A" between clamp arm 22 and the top of toe 16 is reached, clamp 10 may be clamped onto die section 12 solely through actuation of adjustment nut 122 located at the side of platen 14.

In order to clamp device 10 onto die section 14, an operator is simply required to make a single adjustment of adjustment nut 122, nut 122 both positioning and clamping device 10. As adjustment nut 122 is rotated clockwise, advancement screw 30 forces camming assembly 26 toward die section 12. Due to the bias of springs 108, carriage 20 simultaneously advances toward die 12 and slides over, but does not engage, screw 30. Rods 100 and springs 108 initially maintain the spacing of carriage 20 and assembly 26 and prevent the cam dowel 88 from engaging the ramped undersurface 24 of clamp arm 22. However, when bumper bolts 46 abut the edge of die section 12 as shown in FIG. 4, and the advancement of carriage 20 is restrained, the bias force of springs 108 is overcome and screw 30 continues to advance camming assembly 26.

As advancement screw 30 advances assembly 26, thereby converging camming assembly 26 and carriage 20, dowel 88 cams under the ramped undersurface 24 on clamp arm 22. This camming of dowel 88 forces the rear of clamp arm 22 upward, as shown in FIG. 4. This causes arm 22 to pivot on the fulcrum provided by the bearing surface of insert 64, causing the clamping end of clamp arm 22 to be forced downward onto the clamping flange 16 of die 12. Due to the cylindrical shape of dowel 88, a solid contact is maintained along the entire width of the ramped surface of clamp arm 22. Further, since the end surface 76 is beveled upward slightly toward the front of clamp arm 22 the surface 76 clears the edge of the flange 16. Also due to this taper which compensates for the pivotal position of the arm, a maximum surface-to-surface contact is provided between arm 22 and flange 16 which provides a firm clamping action against the top of die shoulder 16. It will be noted that when in a clamped condition shown in FIG. 4, shoulders 42 (FIG. 5) on support base portion 40 firmly abut the overhanging undersurface of channel 32, while shoulders 82 on camming assembly 26 press downward upon the face of platen 14.

Most preferably, the distance between the center of threaded shaft 60 and the nominal centerline or midpoint of the ramped undersurface 24 is approximately twice the distance between the center of threaded shaft 60 and the nominal centerline or midpoint of the beveled contact surface 76. This ratio on the average provides a moment arm or lever between dowel 88 and insert 64 that is roughly twice that of the moment arm or lever between die engaging surface 76 and insert 64. This ratio provides a mechanical advantage that insures a proper clamping action upon die shoulder 16.

In order to unclamp die section 12, adjustment nut 122 is rotated counterclockwise, causing assembly 26 to withdraw from carriage 20 and loosen clamp arm 22. When assembly 26 contacts washer 110, guide rods 100 will withdraw carriage 20 from the side of die 12.

As previously stated, screw 30 can be actuated by a hydraulic motor which can be remotely controlled, or other advancement drives having a torque limiting feature.

As used herein, die section is used generically for any section of a casting die, forging die, mold or the like which is to be mounted on the face of a platen.

It is to be understood that the above is merely a description of the preferred embodiment and that various modifications and improvements may be made without departing from the spirit of the invention disclosed therein. The protection to be afforded is to be determined by the claims which follow and the breadth of interpretation that the law allows.

The embodiments of the invention in which an exclusive property or privilege is claimed are as follows:

1. A clamping device for mounting die sections on machine platens, comprising:

a movable carriage having means for slidably mounting said carriage on the face of a die carrying platen;

a clamp arm pivotally mounted on said carriage, said clamp arm having a die clamping end extending forward of said carriage and a lever end extending rearward of said carriage;

actuating means movably coupled to said carriage for advancement toward and retraction from said carriage, said actuating means including pivoting means for pivoting said clamp arm in response to advancement of said actuating means toward said carriage causing said lever end to be forced away from said platen as said actuating means advances toward said carriage thereby causing said die clamping end to be forced toward said platen for clamping onto a die section and holding said die section on said platen;

means for selectively advancing and retracting both said carriage and said actuating means relative to a platen supported die section when mounted on said platen, and for advancing said actuating means toward said carriage when said clamping end of said clamp arm is adjacent said die section in a die engaging position; and means for activating said advancing means, said activating means being spaced from said carriage and from said actuating means.

2. The clamping device of claim 1, wherein:

said advancing means includes an advancing rod operably coupled to said actuating means, and biasing means disposed between said actuating means and said carriage, said biasing means biasing said carriage forward of said actuating means.

3. The clamping device of claim 2, wherein:

said actuating means includes a T-shaped base, said advancing rod being a screw extending through and engaging said actuating means base; and said carriage includes a T-shaped base aligned with said actuating means base, said carriage base having an aperture extending therethrough, and said threaded rod extending through said carriage base aperture but remaining out of operable engagement with said carriage.

4. A clamping device as defined in claim 3, wherein:

one of said lever end and said actuating means includes a ramped surface thereon, the other of said lever end and said actuating means having a cam surface that selectively engages said ramped surface as said actuating means converges with said carriage.

5. The clamping device of claim 4, wherein:

said cam surface includes a cylindrical contact dowel extending across and contacting said ramped surface as said actuating means converges with said carriage.

6. The clamping device of claim 5, wherein:

said cylindrical contact element is removably mounted on the upper surface of said actuating means.

7. The clamping device of claim 6, wherein:

said carriage includes a mounting rod extending up through said clamp arm, said mounting rod including a fulcrum disposed above said clamp arm, said fulcrum engaging the upper surface of said clamp arm.

8. The clamping device of claim 7, further comprising:

a spring disposed between said carriage and said clamp arm, said spring biasing said clamping arm away from said carriage and against said fulcrum.

9. The clamping device of claim 8, wherein:

said clamp arm includes a semispherical recess on the upper surface thereof, said fulcrum having curved shoulders that abut said clamp arm at said semispherical recess.

10. A clamping device as defined in claim 1, wherein:

one of said lever end and said actuation means includes a cam surface thereon, the other of said lever end and said actuating means having a ramp engaging surface that selectively engages said ramped surface as said actuating surface converges with said carriage.

11. The clamping device of claim 10, wherein:

said cam surface includes a cylindrical contact dowel extending across and contacting said ramped surface as said actuating means converges with said carriage.

12. The clamping device of claim 11, wherein:

said cylindrical contact dowel is removably mounted on the upper surface of said actuating means.

13. The clamping device of claim 1, wherein:

said carriage includes a mounting rod extending up through said clamp arm, said mounting rod including a fulcrum disposed above said clamp arm, said fulcrum engaging the upper surface of said clamp arm.

14. The clamping device of claim 13, further comprising:

a spring disposed between said carriage and said clamp arm, said spring biasing said clamp arm away from said carriage and against said fulcrum.

15. The clamping device of claim 14, wherein:

said fulcrum includes means for selectively adjusting the spacing of said fulcrum from said carriage.

16. A clamping device for mounting die sections on machine platens, comprising:

a movable support carriage having means for slidably mounting said carriage on the face of a die carrying platen;

a clamping arm mounted on said carriage so as to be spaced from a platen face when said carriage is mounted thereon, said clamping arm having a die engaging end;

means for advancing and withdrawing said carriage across a platen face toward and away from a die supported on the platen;

motive means for moving said die engaging end of said clamping arm relative to said carriage toward and away from the face of said platen;

activating means for selectively activating said advancing and withdrawing means to advance and withdraw said carriage, said activating means being spaced from said carriage sufficiently far to provide said activating means with the ability to be disposed adjacent the side of a platen as said clamp arm engages a die thereon, whereby said clamp arm and carriage may be mounted on a platen face and adjusted adjacent the periphery of the platen in order to clamp onto a die section supported thereon; and said activating means including means for selectively activating said motive means for moving said die engaging end of said clamping arm to clamp and unclamp said die onto said platen.

17. The clamping device defined in claim 16, wherein:

said clamping arm is pivotally mounted on said carriage with said die engaging end extending forward of said carriage, said clamping arm having a lever end extending to the rear of said carriage; and said motive means for moving said die engaging end being adapted to selectively pivot said lever end in one direction to produce a corresponding pivoting of said engaging end in an opposite direction.

18. A clamping device as defined in claim 17, wherein:

said motive means for moving said die engaging end includes a camming means movably coupled to said carriage;

said activation means including means for selectively converging and diverging said camming means and support, said camming means engaging said lever end as it converges with said carriage.

19. A clamping device as defined in claim 18, wherein:

one of said lever end and said camming means has a ramped surface thereon, the other of said lever end and said camming means selectively engaging said ramped surface as said camming means converges with said carriage.

20. A clamping device as defined in claim 19, wherein:

said advancing means includes an advancing arm operably coupled to said camming means, so as to be advanced and retracted by advancing arm; and means for biasing said carriage forward of said camming means.

21. A clamping device for mounting die sections on machine platens, comprising:

a movable support block having a T-shaped mounting portion adapted for mating reception in a T-shaped platen channel, said support block having a forward contact surface;

a clamping block pivotally mounted on said support block and spaced above said T-shaped mounting portion, said clamping block having a die clamping end extending forward of said support block and a lever end extending rearward of said support block;

a camming block coupled with said support block to selectively converge and diverge therewith, said camming block having a T-shaped mounting portion adapted for mating reception in a T-shaped platen channel;

one of said lever end and said camming block having a ramped surface thereon, the other of said clamping block and said camming block including a camming means disposed to contact said ramped surface as said camming block and support block converge;

a threaded rod threadedly received in and engaging said camming block; and a spring element resiliently biasing said support block away from said camming block, whereby as said threaded rod is turned in one direction, said camming block and said support block advance until said support block is halted by an object to be clamped, whereupon said camming block converges on said support block and said camming means contacts said ramped surface to pivot said clamping block into a clamped condition.

22. A machine having a pair of spaced, movable platens that diverge and converge to open and close a pair of die sections mounted thereon, comprising:

a plurality of the clamping devices of claim 21 mounted on at least one of said die mounting platens.

23. A clamping device for mounting die sections on machine platens, comprising:

a movable support carriage having means for slidably mounting said carriage on the face of a die carrying platen;

a clamping arm mounted on said carriage so as to be spaced from a platen face when said carriage is mounted thereon, said clamping arm having a die engaging end;

means for advancing and withdrawing said carriage across a platen face toward and away from a die supported on the platen;

motive means for moving said die engaging end of said clamping arm relative to said carriage toward and away from the face of said platen;

said motive means for moving said die engaging end of said clamping arm comprising a camming means movable linearly on said platen toward and away from said die;

said means for advancing said carriage across a platen face toward said die comprising the same said motive means for linearly moving said camming means on said platen toward said die whereby said camming means and carriage are moved simultaneously by said motive means until said clamping arm reaches a predetermined clamping position with respect to said die; and means for causing said motive means to linearly move said camming means toward said die after said clamping arm reaches said predetermined position causing said camming means to engage said clamping arm and move the said engaging end toward said platen face to engage and clamp said die; and actuating means for selectively actuating said motive means for moving said camming means toward or away from said die.

24. The clamping device of claim 23 in which said clamping arm is pivoted on said carriage and said camming means, when actuated, pivots said die engaging end into clamping position.

25. The clamping device of claim 24 in which the clamping arm is pivoted intermediate its ends and the camming means engages the end of said arm opposite said die engaging end.

26. The clamping device of claim 25 in which the said camming means and carriage are separate assemblies normally located in spaced position one from the other between the peripheries of said platen and die, said carriage assembly being located closest to said die; and bias means for biasing said assemblies away from each other; said motive means moving said camming means assembly toward said die and thereby moving said carriage assembly while said biasing means holds said assemblies in said spaced position until said carriage assembly engages said die whereby said camming means converges on said carriage and engages the end of said arm opposite said die engaging end.

* * * * *